US005807140A

United States Patent [19]

Hopkins

[11] Patent Number: 5,807,140

[45] Date of Patent: Sep. 15, 1998

[54] SIGNAL COUPLER WITH A COMMON GROUND PLANE

[75] Inventor: T. Eric Hopkins, Wellesley, Mass.

[73] Assignee: Metrovideo, Inc., Wellesley, Mass.

[21] Appl. No.: 723,604

[22] Filed: Oct. 1, 1996

[51] Int. Cl.[6] ..... H01R 27/00

[52] U.S. Cl. ..... 439/638; 439/639; 439/76.1; 361/686

[58] Field of Search ..... 439/638, 540.1, 439/654, 639, 653, 607, 77, 67, 76.1, 620; 307/43, 51, 69, 72, 75, 80, 85; 395/750.08; 361/686

[56] References Cited

U.S. PATENT DOCUMENTS

| | | | |
|---|---|---|---|
| 4,964,814 | 10/1990 | Tengler et al. | 439/607 |
| 5,030,128 | 7/1991 | Herron et al. | 439/639 |
| 5,330,365 | 7/1994 | Leeson | 439/77 |
| 5,411,416 | 5/1995 | Balon et al. | 439/639 |
| 5,567,180 | 10/1996 | Seo | 439/638 |
| 5,569,052 | 10/1996 | Belt et al. | 439/638 |
| 5,578,876 | 11/1996 | Crampton | 307/80 |

OTHER PUBLICATIONS

McGraw–Hill 12th ed. Materials Handbook pp. 630, 631 & 799.

*Primary Examiner*—Neil Abrams
*Assistant Examiner*—Tho D. Ta
*Attorney, Agent, or Firm*—Thomas J. Engellenner; Anthony A. Laurentano; Lahive & Cockfield, LLP

[57] ABSTRACT

A novel coupler for coupling electrical signals from a multiplicity of electrical connector interfaces to another group of electrical connector interfaces. The coupler advantageously utilizes a flexible printed circuit board of a mylar construction to pass the electrical signals and consequently is inexpensive to manufacture while exhibiting increased reliability. The coupler includes a common ground plane to provide a uniform reference to ground for electrical devices connected to the coupler.

9 Claims, 5 Drawing Sheets

SIGNAL COUPLER WITH A COMMON GROUND PLANE

FIELD OF THE INVENTION

This invention relates generally to the field of electrical signal couplers and more particularly to those signal couplers capable of providing a common ground through use of a printed circuit board connection.

BACKGROUND OF THE INVENTION

Recently it has become feasible and advantageous to connect many video based peripheral devices to personal computer and microprocessor controlled systems. An example of such a video peripheral is a video camera that might be used for image analysis applications. While video peripherals have had the ability to communicate as a remote device in the past, personal computer systems lacked the processor power, speed, and memory to efficiently handle the vast amounts of data presented by these devices. However, with the rapid increase in processor speed and the decrease in the cost of memory for these systems, it has now become computationally feasible to sample video images at a frequency of one to two seconds and perform a meaningful mathematical analysis of the image to exploit the capabilities of this medium. Machine vision applications, perhaps a subset of image analysis applications, are another example of an application that takes advantage of video data. These applications perform a computational analysis of images from video cameras to control machines for industrial processes. They typically require very efficient algorithms, since the sampling frequency of the video images is typically at a high frequency. It is now common for computer systems to provide for the storage, and playback of video images on standard computer display monitors. Additionally, computer programs have been developed to manipulate the stored images, thus giving the user the capability to edit the original video, and produce custom video productions.

In still another application of video technology, video images are transferred to remote computer systems to perform an analysis of premise security. This type of application presents its own challenges since usually a number of cameras are needed to be connected to the systems in order to adequately cover a facility.

Unfortunately while there is an increased desire to connect video devices to personal computer systems, these systems present challenges to this connectivity due to the physical constraints of these systems. Personal computer systems are typically very compact in size, and thus the communication ports on these systems must be densely packed in order to comply with space requirements.

Conventionally, video equipment has been connected to the input ports of a computer system or other electronic equipment by directly wiring them to the computer system or equipment. Typically the wires of multiple video peripherals are joined together in a wiring harness to impose some organization on the wiring connections. However, the wires must be soldered to the input connectors of the communication ports for the computer system. The process of soldering these connections to the communication ports of the computer system is painstaking and error prone. This concern is heightened, of course, when the connector contains multiple pins which must be individually soldered to the wires of the video peripherals bundled together in the wiring harness. A disadvantage of these conventional video connections is the potential that pins on one device will be incorrectly connected to the pins on another device. Furthermore, the electrical connections are necessarily exposed and therefore susceptible to electromagnetic interference, resulting in possible corruption of the signals as they pass through the connection. Since each connection is individually crafted, slight variations in the connections make impedance matching more difficult and make reliable reproduction of the electrical properties of a connection a challenge.

A further disadvantage is that the mechanical stresses imposed on the cable harness through repeated use weaken the electrical connections between the devices, and compromise the reliability of the system.

An addition disadvantage is that the amount of cable required for the connectivity can become physically burdensome, adding to the problem of cable stress. These cables clutter the workspace making them difficult to follow, and are easily entangled. Although this can be mitigated by organizing the cables into a bundle and placing the bundle neatly along walls or under floors, this invariably increases the cables' length and therefore their cost.

Moreover, the conventional method of directly wiring the remote devices to the computer system dictates in practical terms that a separate reference point for ground be established for each connection. Clearly, this complicates signal analysis and detection for the system since the quantization of the signals may be different for each wiring connection.

While these disadvantages may be tolerated and overlooked with a smaller number of video cameras, as the number of video cameras increases these disadvantages become magnified and it becomes clear that a better way of connecting these video devices is needed.

Thus it is seen that it is desirable to provide an electrical coupler capable of forming reliable, electromagnetically shielded connections between devices, and capable of being easily disconnected from and reconnected to an electrical device while providing a uniform reference to ground for all devices connected thereto. It is also desirable that manufacture of such a coupler be inexpensive, so as not to be an impediment to use on personal computer systems.

It is thus an object of the present invention to obviate the known disadvantages of the prior art by providing a coupler having a plurality of ports each of which is capable of being connected and disconnected from a signal source without the necessity of soldering electrical connections directly .

It is a further object of the invention to provide for a coupler of electrical signals that incorporates a common ground plane to establish a uniform reference point for ground.

It is a further object of the invention to provide for a coupler of electrical signals that is inexpensive to manufacture.

It is a further object of the invention to provide for a coupler of electrical signals that incorporates a power jack for selecting a source of power for the devices connected to the coupler.

It is a further object of the invention to provide for a coupler of electrical signals that reduces the corruption of these signals due to electromagnetic interference.

It is a yet further object of the invention to provide a coupler that reduces mechanical stress that tend to weaken or break the electrical connection between the signal sources.

It is a still further object of the invention to provide a coupler of electronic signals that permits ease of connectivity to a personal computer.

Other general and more specific objects of the invention will in part be obvious and will in part appear from the drawings and description which follow.

SUMMARY OF THE INVENTION

In one aspect of the present invention, a coupler is provided that efficiently permits the connection of multiple connection interfaces. The coupler in accordance with the instant invention comprises a chamber having conducting walls and containing structure forming electrical pathways that passes signals to a second connection interface. The respective communication interfaces allow for utilization of standard connectors, thus facilitating connection and removal of communication devices without the need to solder and unsolder connections. In a further aspect of this invention, the chamber contains a printed circuit board, constructed as a flex circuit board, on which are imprinted the electrical pathways required to interconnect a multiplicity of peripherals such as video cameras with a data processing system.. The printed circuit board advantageously includes a common ground plane to provide a uniform ground reference for all grounding pins connected to the coupler. Furthermore, a power supply jack is also configured on the coupler to provide the option of selecting the internal power of a computer system or external power to energize the devices connected to the coupler.

In one aspect of the invention there is described herein a coupler for coupling electrical signals comprising: a housing, having first and second faces, for shielding said electrical signals from electromagnetic interference; a printed circuit board enclosed in said housing and having a plurality of electrically conductive paths thereupon, each of said electrical paths including first and second points of terminus; a first electric connector coupled to said first face of said housing, said first electrical connector having a first plurality of electrical leads for transporting said electrical signals; a second electrical connector coupled to said second face of said housing having a second plurality of electrical leads for transporting said electrical signals; wherein said first plurality of electrical leads are coupled to said first plurality of points of terminus and said second plurality of electrical leads are coupled to said second plurality of points of terminus.

BRIEF DESCRIPTION OF THE DRAWINGS

The foregoing and other objects, features and advantages of the invention will be apparent from the following description and apparent from the accompanying drawings, in which like reference characters refer to the same parts throughout the different views. The drawings illustrate principles of the invention and, although not to scale, show relative dimensions.

DETAILED DESCRIPTION OF THE ILLUSTRATED EMBODIMENT

A novel and non-obvious coupler is described herein that permits the connection of a multiplicity of communication devices such as video peripherals to a second connector interface through a flexible printed circuit board that advantageously provides for a common ground reference.

Figure 1:
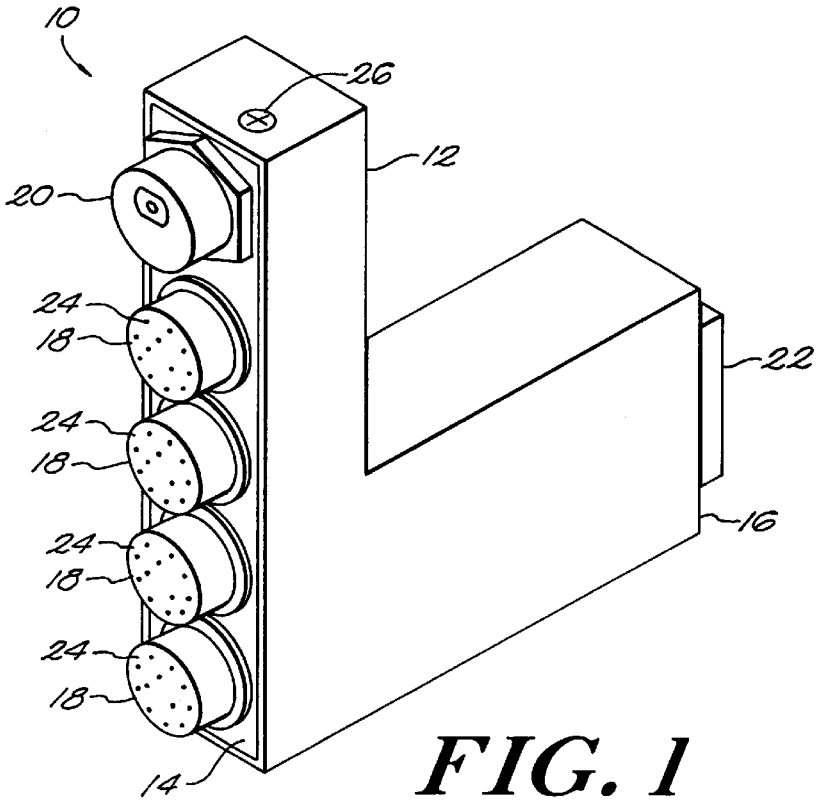
FIG. 1 depicts a perspective view of a coupler in accordance with the instant invention having four connector interfaces on one side of the coupler, and another connector interface on a second side of the coupler.

Referring now to FIG. 1 wherein is shown one embodiment of an electrical coupler in accordance with the present invention. A coupler 10 consists of a housing 12 with a multiplicity of faces. Housing 12 is shown in FIG. 1 to have an "L" shape, but one of ordinary skill in the art will recognize that the housing may take on many alternative shapes while being suitable to practice the invention. Housing 12 includes a first face 14 and a second face 16. Although not a requirement, in the illustrated embodiment the first face 14 and the second face 16 of the housing 12 are oppositely positioned. In the most general aspect of the invention, the first face 14 of the housing 12 is appropriately sized and configured to mount a multiplicity of serial aligned first connector interfaces 18 for communicating with a remote device. The connector interface 18 permits communication of electrical signals for either the transfer of data or command and status information. Typically connector interfaces 18 consist of a multiplicity of leads or pins 24 which make available to connector interfaces 18 external electrical signals impressed thereupon. It is typical for at least one and perhaps more of these leads 24 to be connected to a ground source. Examples of these connector interfaces are the 25 pin connector associated with the RS232C standard, a BNC connector for a coaxial cable, and the connector corresponding to the Centronics parallel printer interface standard. In one embodiment of the invention, the connector interfaces are suitable for interfacing video cameras and the like to the coupler of the instant invention using the DSUB standard interface. In one embodiment of the invention each of the four connectors shown in FIG. 1 is configured as a cylindrical receptacle having twelve leads or pins to communicate video signals. However, it will be recognized by one of skill in the art that the current invention is not limited to the examples of connector interfaces cited herein, but rather can be applied generically to a large class of connector interfaces. Furthermore it will be appreciated that the number of connector interfaces 18 on the first face of the housing is not a specific limitation of the current invention. While FIG. 1 depicts a coupler with four (4) connector interfaces 18, it is feasible to practice the teachings of the invention for a coupler with one or more connector interfaces 18 on the first face 14 of housing 12.

The first face 14 of housing 12 further includes a DC power jack 20, shown in serial alignment with the connector interfaces 18, for interfacing with an external power source. This power jack 20 permits the electrical devices interfacing with the first connector interfaces 18 to accept power from either the internal power of the computer system to which the coupler is connected or an external power source through power jack 20. When a power supply is connected to the coupler through power jack 20, the electrical devices connected to the first connector interfaces 18 are powered by this external source. However, if no power supply is connected to power jack 20, the electrical devices derive power from the computer system to which the coupler is connected.

The housing 12 is preferably constructed of materials which protect the device from mechanical damage while concomitantly reducing external electromagnetic interference within the housing itself. For example, housing 12 may be constructed of metal and designed as a conductive chamber, thus acting as a Faraday cage. A Faraday cage shields external electromagnetic interference from affecting wave propagation within housing 12. In another embodiment, housing 12 is constructed of a non-conducting material such as a plastic with a conductive coating 42 of FIG. 4 applied thereto which then again defines a conductive chamber for isolating electromagnetic interference inside the chamber.

The second face 16 of housing 12 incorporates a second connector interface 22 including a multiplicity of leads or pins for communicating with a remote device through electrical signals impressed on the leads or pins of the second connector interface. Like the connector interface 18 on the first face 14 of the housing, the connector interface 22 of the second face 16 permits communication of electrical signals for either transfer of data or command and status information. Typically connector interfaces consist of a multiplicity of leads or pins to interface to external electrical signals. Examples of these connector interfaces are the 25 pin connector associated with the RS232C standard and the connector corresponding to the Centronics parallel printer interface standard. In one embodiment of the invention, the connector interface residing on the second face of the housing is suitable for interfacing and mating to a serial interface port of a digital computer. A serial interface port supports a connector receptacle having a generally trapezoidal shape comprising twenty six leads or pins for communicating in one application video signals. Again, it will be recognized by one of skill in the art that the current invention is not limited to the examples of connector interfaces 22 described herein, but rather can be applied to generically to a large class of connector interfaces 22.

The first connector interfaces 18 and the DC power jack 20 are fastened to the housing 12 and locked into place utilizing a screw assembly 26.

Figure 2:
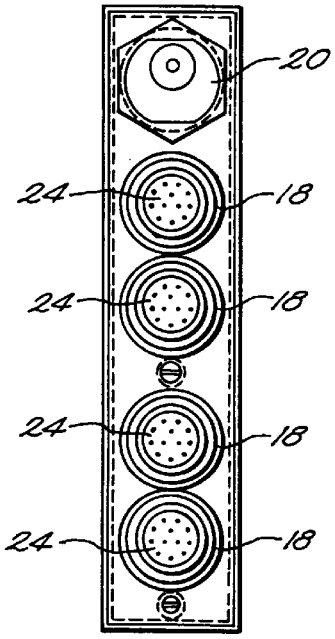
FIG. 2 depicts a frontal view of a the coupler of FIG. 1 having video connector interfaces in accordance with the instant invention.

FIG. 2 is a frontal view of the first face of one embodiment of the coupler showing four connector interfaces 18, each suitable for connecting a video camera or video equipment. Each of the four connectors shown in FIG. 1 is configured as a cylindrical receptacle having twelve leads or pins to communicate the video signals.

Figure 3:
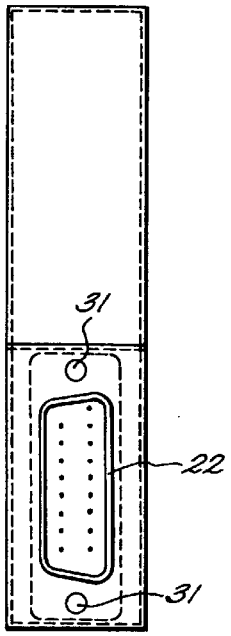
FIG. 3 depicts a rear view of a the coupler of FIG. 1 having a serial connector interface in accordance with the instant invention.

FIG. 3 is a rear view of FIG. 1 showing the second face of the coupler with the second connector interface 22 embodied as a serial data connector for mating the coupler to the serial interface port of a digital computer. A serial interface port of a digital computer supports a connector receptacle having a generally trapezoidal shape comprising twenty six leads or pins for communicating electrically in one example application, video signals. Second face 16 includes screws 31 for securely fastening the serial connector interface to the housing 12.

As was previously disclosed, it is typical for some of the leads of the connectors of the coupler to be connected to a source of ground. From a performance and reliability perspective it is advantageous to connect all ground connections to a common ground, thus providing a uniform reference point of ground, and permitting a consistent reference for the measurement of electrical parameters among the pins. The coupler of the instant invention advantageously provides for this capability as follows.

Figure 4:
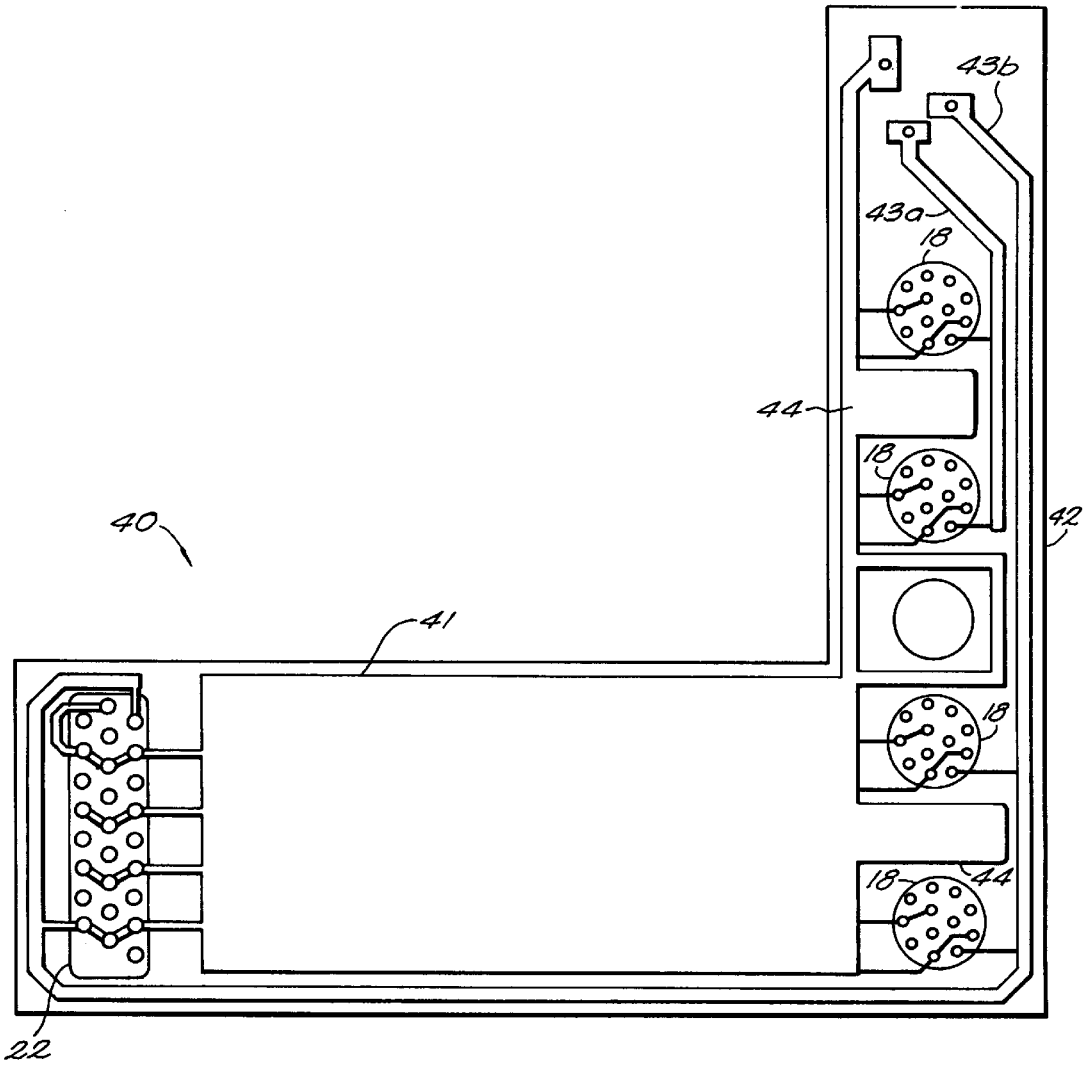
FIG. 4 is an illustration representative of one side of a printed circuit board mounted within the coupler of FIG. 1 having a ground plane to make common ground connections and power strips for supplying power from a common source.

Referring now to FIG. 4, a printed circuit board (PCB) 40 is depicted having in the layout on one side of the PCB 40 a ground plane 41 for supplying a path to a common ground source for the grounding leads of the connector interfaces 18 and 22. This common ground reference may be derived from the ground reference used by the computer system which is connected to by the second connector interface 22 of FIG. 1, and consequently a uniform ground reference can be established for the computer system and the coupler. Furthermore PCB 40 provides connection points 43*a* and 43*b* permitting the electrical devices connected to the coupler to be powered either by the internal power of the computer system to which the coupler is attached or by the external power supplied through power jack 20. When no power plug is connected to power jack 20, connection points 43*a* and 43*b* are shorted, and the electrical devices derive power from the connected computer system. However if a power plug is connected to power jack 20, the path between connection points 43*a* and 43*b* is opened and the devices take power from the supply attached to power jack 20. Power jack 20 is constructed such that the path between connection points 43*a* and 43*b* is opened prior to the availability of power to the coupler. Ground protrusions 44 on PCB 40 provide an electrical sink to ground between the closely placed connector interfaces, thus improving electrical isolation between the connector interfaces.

Printed circuit board 40 is in one embodiment a flex circuit board in that it is constructed from a flexible material that allows for the bending and deformation of the board without damage to the device. These flex circuit boards utilize a mylar construction using materials such as CAPTON from DuPont. A flex board provides the advantages of low cost and reduction in space required while at the same time providing ease of manufacture with increased coupler reliability. The use of a flex printed circuit board 40 further facilitates the implementation of impedance matching between connection interfaces 18 and 22, thus providing again a more reliable connection with better noise and interference characteristics. The techniques for impedance matching on a printed circuit board are conventional and are known to those of ordinary skill in the art.

Figure 5:
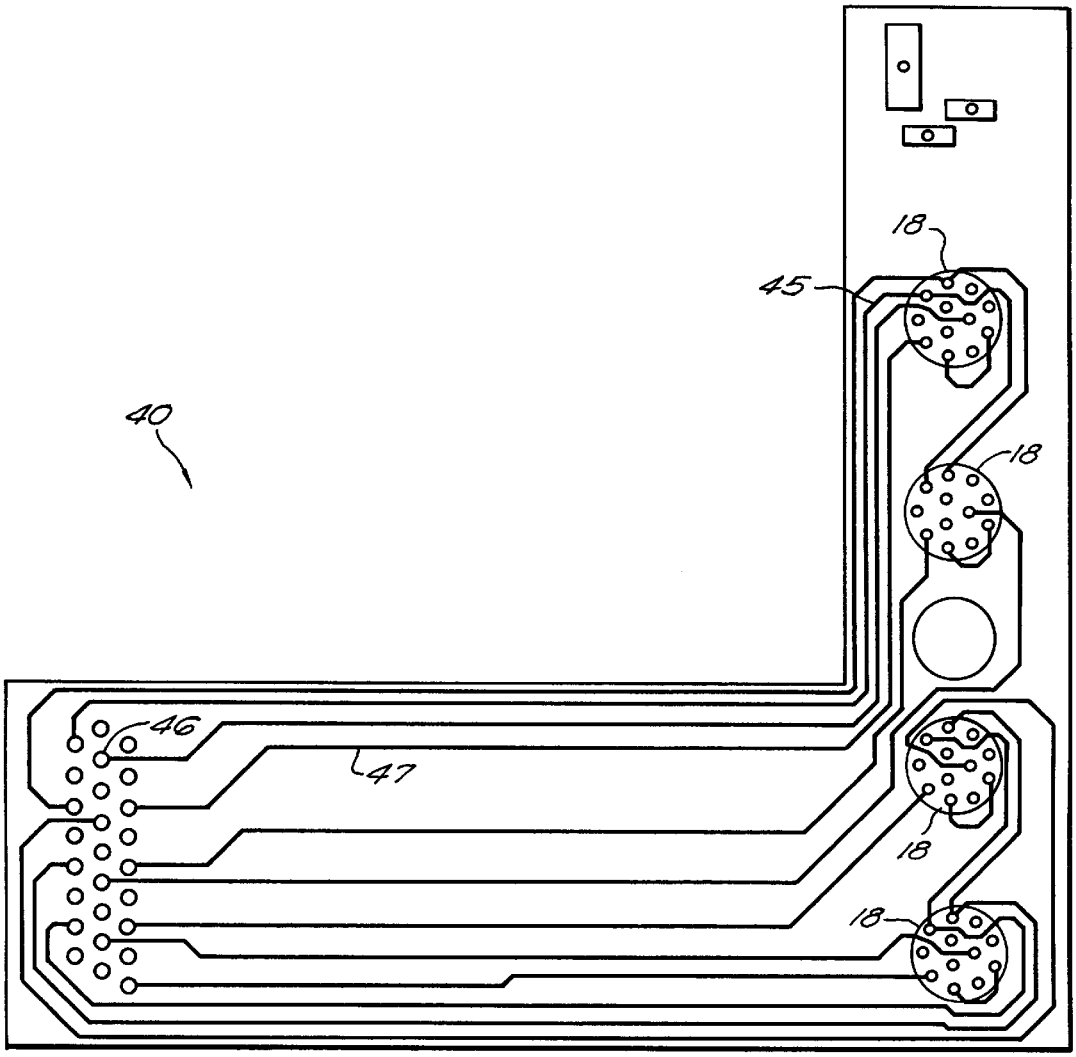
FIG. 5 is an illustration representative of the other side of the printed circuit board of FIG. 4 allowing for electrical connections from a first connector interface to a second connector interface.

Referring now to FIG. 5, the layout of printed circuit board (PCB) 40 is shown for the opposite side of the board. On this side of the board, electrical connections are accomplished between the point of terminus 45 for the connector interfaces on the first face 14 of the housing 12 and the point of terminus 46 for connector interface on the second face 16 of the housing 12 through conductive paths 47 incorporated into the surface of the printed circuit board 40. In one embodiment of the invention, the first connector interface 18 is realized as a 12 lead or pin connector suitable for receiving video signals from video cameras and the second connector interface 22 is realized as a 26 lead or pin standard serial connector suitable to interface the video signals to a digital computer. Video signals impressed on the leads 24 of the first connector interface are mapped to the twenty six pins of the serial port realization for the second connector interface 22.

Figure 6:
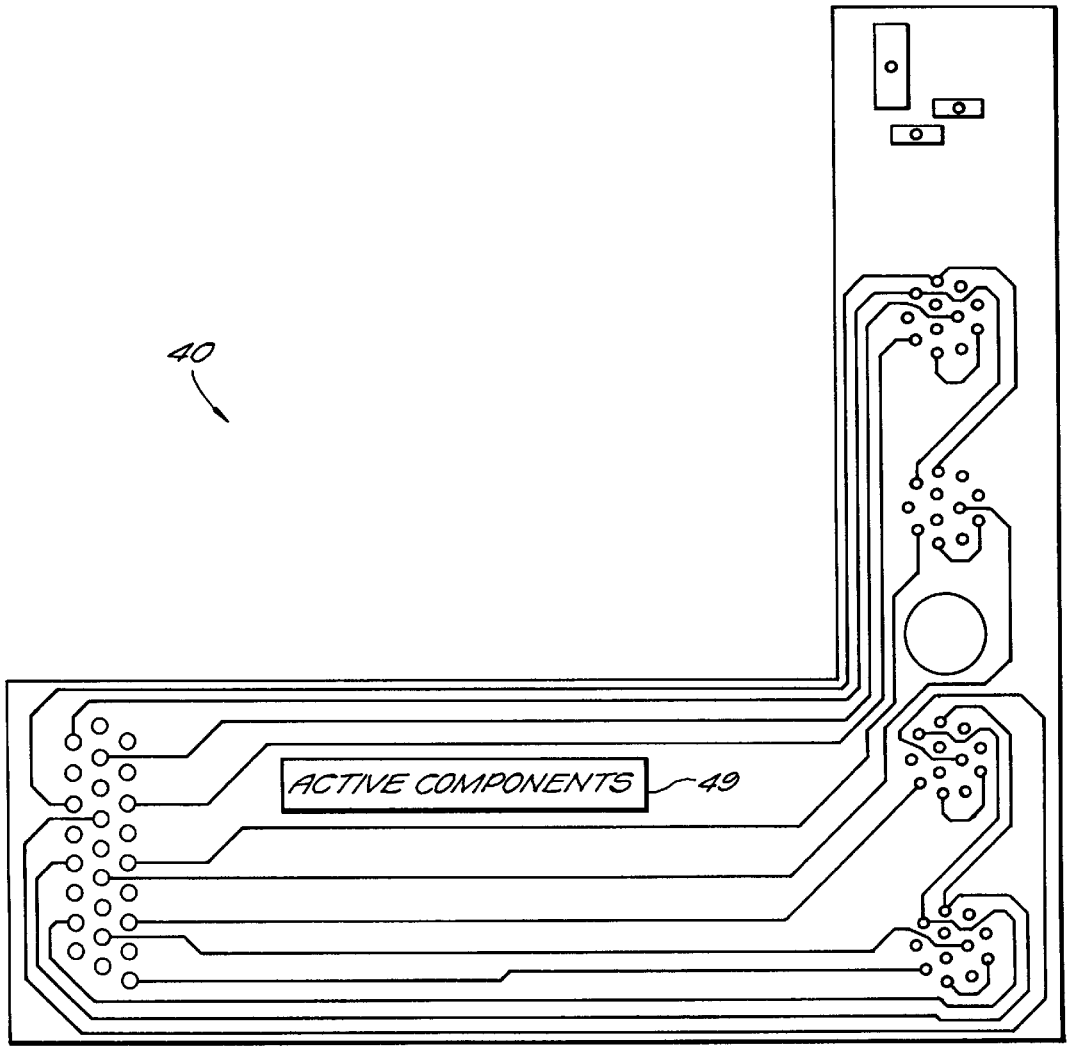
FIG. 6 is an illustration of the printed circuit board of FIG. 5 having an active electronic component mounted thereon.

In another embodiment of the invention, PCB 40 is shown in FIG. 6 to include thereon the mounting of active electronic components 49. Examples of these active components are amplifiers, a microprocessor including memory, or discrete logic gates. Providing active components on the printed circuit board allows for the implementation of selective manipulation of the electrical signals between the connector interfaces. The techniques for mounting of these active components on the printed circuit board are conventional and are known to those of ordinary skill in the art.

Figure 7:
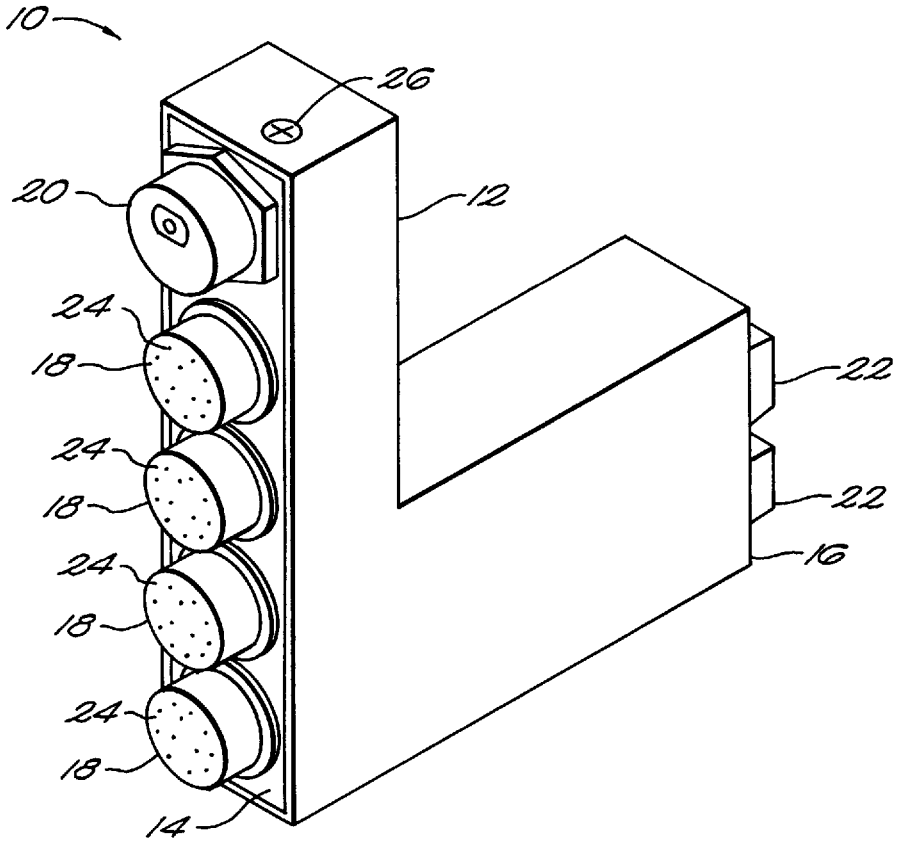
FIG. 7 depicts a coupler in accordance with the present invention having multiple connector interfaces on each side of the coupler.

In a still further embodiment of the invention, FIG. 7 depicts a coupler 10 having multiple connection interfaces 18 on a first face 14 of a housing 12 coupled in accordance with the description of the invention herein to connection interfaces 22 on a second face of housing 12. In this embodiment two connection interfaces are shown, but one of ordinary skill in the art will recognize that more than two connection interfaces 22 are possible within the scope of the invention.

As was previously described, video equipment such as cameras and the like have been conventionally connected to a computer system by directly wiring them to the input ports of the system. The coupler of the present invention is a clear advantage over this conventional method in that the need for a wiring harness to organize the wire connections is eliminated. Moreover, the soldering of the wires to the input ports is no longer necessary, and thus the reliability and performance of the connections can be increased. The incorrect wiring of the pins is of course also avoided as a source of error.

Furthermore, as the coupler employs a housing to protect the printed circuit board from damage due to mechanical stresses and adverse environmental effects, the reliability of the coupler connection is thus necessarily increased, and better performance can be expected to be achieved. It has also been shown that the construction of the housing for this novel coupler advantageously reduces the corruptive effects of externally generated electromagnetic interference, and that the common ground plane on the printed circuit board importantly establishes a uniform reference for ground, thus providing a reliably consistent reference for electrical measurements.

As was, shown the use of a flex printed circuit board allows for ease of manufacturing and low cost while providing the flexibility to introduce impedance matching and microprocessor capabilities.

It is thus seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

Having described the invention, what is claimed as new and desired to be secured by Letters Patent is:

1. A coupler for coupling electrical signals between a computer system and an imaging device, said coupler comprising:

a housing, for shielding said electrical signals from electromagnetic interference, having a first face for interfacing to said imaging device and a second face for interfacing to said computer system;

a printed circuit board enclosed in said housing and having a plurality of electrically conductive paths thereupon, each of said electrical paths including first and second points of terminus, said printed circuit board including circuitry for selectively powering said imaging device from said computer system or from an external power supply;

a first plurality of electrical connector interfaces coupled to said first face of said housing, each of said first plurality of electrical connector interfaces having a first plurality of electrical leads for transporting said electrical signals; wherein said first face including a power jack for providing power from said external power supply to said first plurality of electrical connector interfaces;

a second electrical connector interface coupled to said second face of said housing having a second plurality of electrical leads for transporting said electrical signals;

wherein at least one of said first plurality of electrical leads of said imaging device are coupled to and passively impedance matched to said second plurality of electrical leads of said computer system.

2. The apparatus of claim 1 wherein one of said first plurality of electrical connector interfaces is a connector for mating to a DSUB connector.

3. The apparatus of claim 1 wherein said second electrical connector interface includes a connector for mating to a serial connector for a digital computer.

4. The apparatus of claim 1 wherein said housing for an electrical signal from external electromagnetic interference comprises a chamber having conducting walls.

5. The apparatus of claim 1 wherein said housing for an electrical signal from external electromagnetic interference comprises a chamber of non conductive material with a conductive coating.

6. The apparatus of claim 1 wherein said printed circuit board includes active components for selectively manipulating said electrical signals.

7. The apparatus of claim 1 wherein said printed circuit board is a flex printed circuit board.

8. The apparatus of claim 1 wherein said printed circuit board is constructed from mylar.

9. A coupler for coupling electrical signals including a plurality of ground signals between a computer system and an imaging device, said coupler comprising:

a housing, for shielding said electrical signals from electromagnetic interference, having a first face for interfacing to said imaging device and a second face for interfacing to said computer system;

a printed circuit board enclosed in said housing and having a plurality of electrically conductive paths thereupon, each of said electrical paths including a first and second point of terminus, said printed circuit board including circuitry for selectively powering said imaging device from said computer system or from an external power supply;

said printed circuit board further forming a common ground connection for said ground signals;

a first plurality of electrical connector interfaces coupled to said first face of said housing, each of said first plurality of electrical connector interfaces having a first plurality of electrical leads for transporting said electrical signals; wherein said first face including a power jack for providing power from said external power supply to said first plurality of electrical connector interfaces.

a second electrical connector interface coupled to said second face of said housing having a second plurality of electrical leads for transporting said electrical signals;

wherein at least one of said first plurality of electrical leads of said imaging device are coupled to and passively impedance matched to said second plurality of electrical leads of said computer system and all said ground signals are coupled to said common ground connection.

* * * * *